US008176709B2

(12) United States Patent
Siodla

(10) Patent No.: US 8,176,709 B2
(45) Date of Patent: May 15, 2012

(54) COMPOSITE PROFILE FOR WINDOW, DOOR OR FACADE ELEMENT

(75) Inventor: Thorsten Siodla, Baunatal (DE)

(73) Assignee: Technoform Bautec Holding GmbH, Kassel (DE)

( * ) Notice: Subject to any disclaimer, the term of this patent is extended or adjusted under 35 U.S.C. 154(b) by 251 days.

(21) Appl. No.: 12/486,582

(22) Filed: Jun. 17, 2009

(65) Prior Publication Data

US 2009/0313941 A1 Dec. 24, 2009

(30) Foreign Application Priority Data

Jun. 18, 2008 (EP) ..... 08011031

(51) Int. Cl.
*E04C 2/38* (2006.01)

(52) U.S. Cl. ..... 52/800.13; 52/656.2; 52/232; 52/204.5; 49/1; 49/7; 49/DIG. 1

(58) Field of Classification Search ..... 52/656.2, 52/656.3, 656.4, 656.5, 800.13, 800.15, 784.1, 52/784.11, 232, 204.5; 49/1, 7, DIG. 1
See application file for complete search history.

(56) References Cited

U.S. PATENT DOCUMENTS

| | | | | |
|---|---|---|---|---|
| 3,861,085 | A * | 1/1975 | Jacob | 49/501 |
| 3,878,660 | A * | 4/1975 | Jacob | 52/573.1 |
| 4,067,163 | A * | 1/1978 | Hetman | 52/204.591 |
| 4,115,972 | A * | 9/1978 | Varlonga | 52/204.593 |
| 4,158,512 | A * | 6/1979 | Hasselbacher | 403/294 |
| 4,219,983 | A * | 9/1980 | Kern et al. | 52/204.599 |
| 4,272,941 | A * | 6/1981 | Hasselbacher et al. | 52/844 |
| 4,314,424 | A * | 2/1982 | Gordon et al. | 49/400 |
| 4,397,116 | A * | 8/1983 | Habicht et al. | 49/501 |
| 4,524,112 | A * | 6/1985 | Willert | 428/595 |
| 4,777,777 | A * | 10/1988 | Massimo | 52/586.2 |
| 4,896,613 | A * | 1/1990 | Salzer | 109/27 |
| 5,117,601 | A * | 6/1992 | Habicht | 52/281 |
| 5,492,208 | A * | 2/1996 | Goossens | 292/2 |
| 5,641,239 | A * | 6/1997 | Michalek | 403/397 |
| 5,694,731 | A | 12/1997 | Tonsmann et al. | |
| 6,035,596 | A * | 3/2000 | Brunnhofer | 52/404.1 |
| 6,035,600 | A * | 3/2000 | Habicht et al. | 52/717.02 |
| 6,216,401 | B1 * | 4/2001 | Emek | 52/204.5 |
| 6,339,909 | B1 * | 1/2002 | Brunnhofer et al. | 52/786.13 |
| 6,615,544 | B1 * | 9/2003 | Tlemcani et al. | 49/7 |

(Continued)

FOREIGN PATENT DOCUMENTS

DE 35 45 092 A1 4/1987

(Continued)

*Primary Examiner* — Brian Glessner
*Assistant Examiner* — Rodney Mintz
(74) *Attorney, Agent, or Firm* — J-Tek Law PLLC; Jeffrey D. Tekanic

(57) ABSTRACT

A composite profile for a window, door or façade element includes first and second outer profile parts and at least one insulating strip connecting the first and second outer profile parts with an intermediate space defined between them for thermal separation. At least one outer profile part connecting element is disposed in the intermediate space so that it is normally not in contact with the first and second outer profile parts. An actuating element is disposed so that, upon being activated by heat, it moves the outer profile part connecting element into engagement with the first and second outer profile parts, so that the outer profile part connecting element connects the first and second outer profile parts.

20 Claims, 2 Drawing Sheets

U.S. PATENT DOCUMENTS

| | | | | |
|---|---|---|---|---|
| 6,668,499 | B2 * | 12/2003 | Degelsegger | 52/204.62 |
| 6,764,728 | B2 * | 7/2004 | Emek | 428/34 |
| 7,104,019 | B2 * | 9/2006 | Brunnhofer | 52/407.1 |
| 7,598,460 | B2 * | 10/2009 | Roberts et al. | 174/382 |
| 7,841,139 | B2 * | 11/2010 | Dampierre | 52/204.68 |
| 7,913,470 | B2 * | 3/2011 | Siodla et al. | 52/586.2 |
| 7,921,603 | B2 * | 4/2011 | Darnell | 49/504 |
| 7,987,633 | B2 * | 8/2011 | Lenox et al. | 49/504 |
| 2002/0046539 | A1 * | 4/2002 | Schulz | 52/730.4 |
| 2002/0166298 | A1 * | 11/2002 | Emek | 52/208 |
| 2005/0100691 | A1 * | 5/2005 | Bunnhofer et al. | 428/34 |
| 2005/0115193 | A1 | 6/2005 | Brunnhofer | |
| 2005/0166496 | A1 * | 8/2005 | Farag | 52/204.57 |
| 2005/0183351 | A1 * | 8/2005 | Brunnhofer | 52/204.5 |
| 2005/0284030 | A1 * | 12/2005 | Autovino et al. | 52/1 |
| 2006/0048466 | A1 * | 3/2006 | Darnell | 52/204.1 |
| 2006/0191217 | A1 * | 8/2006 | Harkins et al. | 52/232 |
| 2008/0127596 | A1 * | 6/2008 | Wildenhain et al. | 52/656.3 |
| 2008/0178552 | A1 * | 7/2008 | Dampierre | 52/656.2 |
| 2008/0196342 | A1 * | 8/2008 | Franklin | 52/309.1 |
| 2008/0256893 | A1 | 10/2008 | Siodla | |
| 2008/0282628 | A1 * | 11/2008 | Lenox et al. | 52/204.63 |
| 2009/0031665 | A1 * | 2/2009 | Esen | 52/656.2 |
| 2010/0115850 | A1 * | 5/2010 | Siodla et al. | 49/493.1 |
| 2011/0099937 | A1 * | 5/2011 | Dampierre | 52/656.5 |
| 2011/0283625 | A1 * | 11/2011 | Lenox et al. | 49/425 |

FOREIGN PATENT DOCUMENTS

| | | | | |
|---|---|---|---|---|
| DE | 195 04 601 | A1 | | 7/1996 |
| DE | 297 04 201 | U1 | | 8/1997 |
| DE | 100 63 894 | A1 | | 6/2002 |
| DE | 20 2004 005 682 | U1 | | 7/2004 |
| DE | 20 2007 016 649 | U1 | | 6/2008 |
| EP | 0 667 439 | B1 | | 10/1998 |
| EP | 0 785 334 | B1 | | 2/1999 |
| EP | 1 327 741 | A2 | | 7/2003 |
| EP | 1 182 317 | B1 | | 12/2003 |
| EP | 1 024 243 | B1 | | 9/2004 |
| EP | 1 793 073 | A2 | | 6/2007 |
| EP | 2317059 | A1 | * | 5/2011 |
| GB | 2413145 | A | * | 10/2005 |
| WO | WO 2011050954 | A1 | * | 5/2011 |

* cited by examiner

Fig. 2
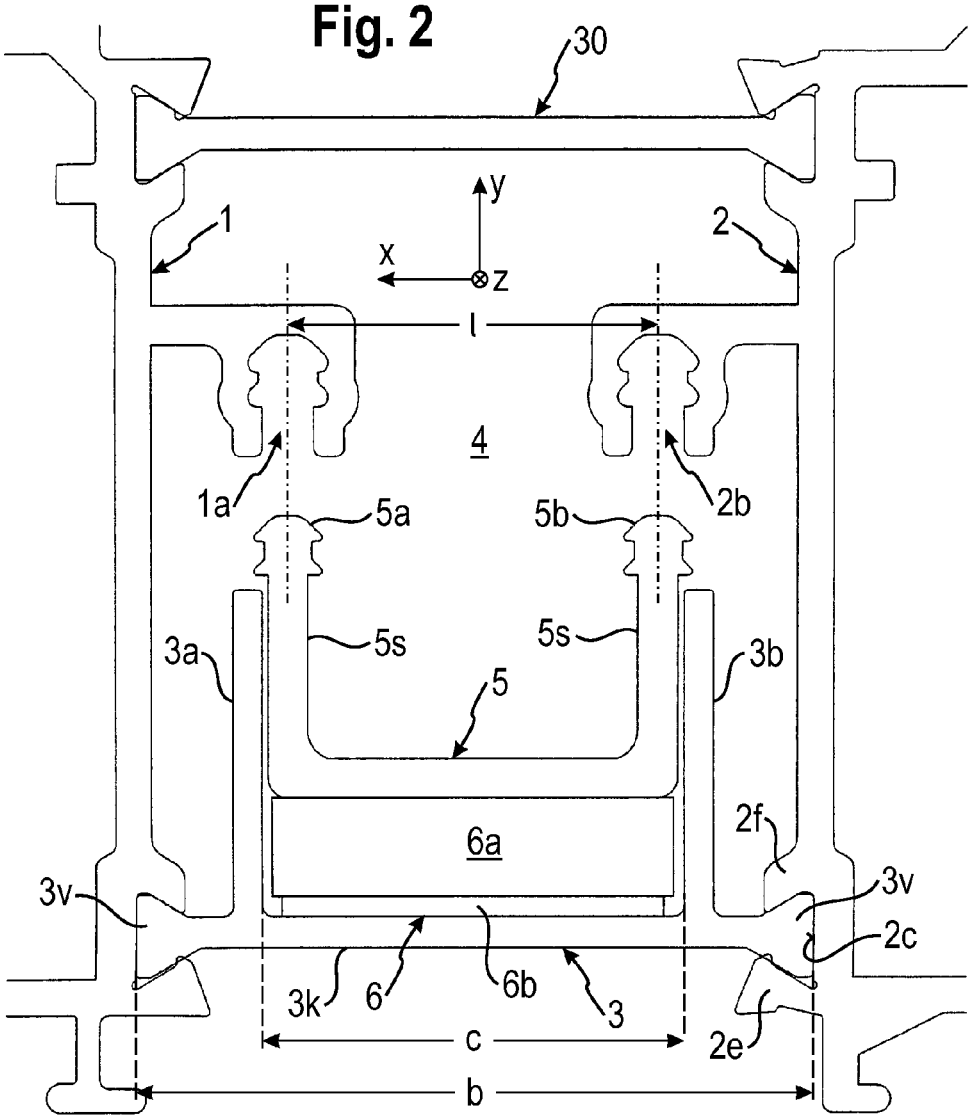
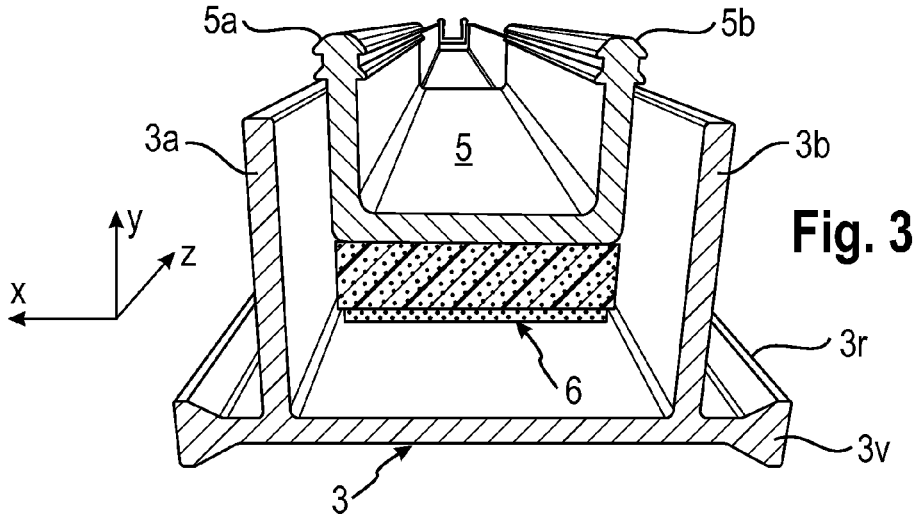
Fig. 3

COMPOSITE PROFILE FOR WINDOW, DOOR OR FACADE ELEMENT

CROSS-REFERENCE

The present application claims priority to European patent application number 08 011 031.5, filed Jun. 18, 2008, the contents of which are fully incorporated herein by reference.

TECHNICAL FIELD

The present invention relates to a composite profile for a window, door or façade element, which preferably have predetermined fire resistance properties, and to an apparatus for connecting profile or frame parts of such a composite profile.

BACKGROUND ART

Industrial buildings and office buildings are typically designed so as to be subdivided into 'fire compartments' in order to provide passive fire protection for limiting or retarding the spread of fire, smoke, poisonous gases and/or damaging heat in case of a fire. For this purpose, the doors and windows that are utilized in the building must have predetermined fire resistance properties, which are ascertained by performing a standard fire resistance test on the structural element. According to the results of the standard fire resistance test, the structural element is classified into a fire resistance class or rating, e.g., D30, D60, D90. Herein, the alphabetic letter indicates the usage (e.g., D=door) and the number indicates the length of time in minutes that the structural element has withstood the heat applied thereto during the standard fire resistance test.

The standard fire resistance test provides an indication of how long the structural element will enable the fire compartments to remain securely separated and air-tight under standard fire conditions, so that, e.g., gases generated during a fire are prevented from reaching the side of the structural element facing away from the fire. It is also important that the temperatures on the side facing away from the fire are not permitted to rise for the prescribed period time to a point that will cause the ignition of easily-ignited materials located there.

Aluminum composite profiles or frames are often utilized in window, door and façade elements installed in industrial and office buildings. Since the aluminum itself will start to melt at the temperatures associated with a fire, a cooling medium (e.g., intumescent materials and/or water-absorbent materials such as gypsum-alum, see e.g., DE 44 43 762 A1 or its English counterpart U.S. Pat. No. 5,694,731) is often disposed in the composite profile prior to installation in the building. The aluminum composite profile is normally comprised of at least two aluminum profile parts, the aluminum inner frame and the aluminum outer frame. One or more insulating strips connect the aluminum inner frame and the aluminum outer frame while also providing a thermal separation of the two frames, thereby reducing heat conduction from the inner frame to the outer frame and vice versa during normal usage and thus improving the insulating characteristics of the structural element as a whole. In composite profiles having increased fire resistance properties, the insulating strips connecting the aluminum inner frame and the aluminum outer frame are usually not exclusively manufactured from thermoplastic synthetic materials. Either the thermoplastic synthetic material is replaced with a non-melting, thermosetting synthetic material, or metal bridges, e.g., steel brackets, are utilized, at least sectionally.

However, thermosetting synthetic materials have the disadvantage of poor workability. Thermosetting synthetic materials, in particular, are difficult to cut properly when the composite profile must be sawed into segments of specific lengths during the finishing process. The use of steel brackets or other metal bridges has the disadvantage of requiring a large amount of manual labor.

Another known approach utilizes a plurality of aluminum bridges that conduct a defined amount of heat from the fire side to the side facing away from the fire. This approach is disadvantageous because heat is also continuously conducted across the aluminum bridges during normal usage. Thus, such an approach reduces the thermal separation of the aluminum inner frame from the aluminum outer frame and thus reduces the insulating properties of the structural element as a whole.

EP 1 024 243 A2 describes a composite profile having a fireproof, supplemental element in the form of a metal bracket that is adhered onto the insulating strip and in the normal state extends in receiving spaces of the outer profile parts.

EP 1 182 317 A2 describes a composite profile having fire resistance properties, in which the insulating strip is comprised, in sections, of metal instead of a thermoplastic synthetic material.

EP 0 785 334 B1 describes a composite profile, wherein the outer profile parts are not connected by fireproof insulating strips. A fireproof, shaped material is connected with the outer profile parts in a form-fitting manner.

A composite profile having fire resistance properties is known from DE 44 43 762 A1 and its English counterpart U.S. Pat. No. 5,694,731, wherein the insulating strips are either perforated metal rails or perforated synthetic material rails, in which the synthetic material is replaced, in sections, with bridge strips made of metal. A fire-resistant strip can be provided on an insulating strip.

Further composite profiles having fire resistance properties are known from EP 1 327 741 A2 and DE 44 04 565 C1/EP 667 439 B1.

SUMMARY

It is an object of the invention to overcome one or more problems of the known art.

In one aspect of the present teachings, an improved composite profile for a window, door or façade element having predetermined fire resistance properties is provided.

In another aspect of the present teachings, an improved connector device for a composite profile is provided.

The present composite profile and connecting devices are preferably configured to provide a secure connection of outer profile parts or frames in case of a fire, as well as provide a good thermal separation of the outer profile parts or frames during normal usage.

In a first preferred aspect of the present teachings, a composite profile for a window, door or façade element having predetermined fire resistance properties is provided and preferably includes a first outer profile part or frame and a second outer profile part or frame. At least one insulating strip is connected with the first and second outer profile parts so that the first and second outer profile parts are spaced from one another with an intermediate space defined between them for thermal separation. In addition, at least one outer profile part connecting element is disposed in the intermediate space so that it is not in engagement with the first and second outer profile parts during normal usage and is spaced from them during normal usage for thermal separation. At least one heat-activated actuating element is preferably provided that, upon being activated by heat such as heat associated with a fire, causes the outer profile part connecting element to move into engagement with the first and second outer profile parts, wherein the outer profile part connecting element connects the first and second outer profile parts.

By providing the actuating element, which is activated by the heat generated in case of a fire, and by actively moving the outer profile part connecting element into engagement with the outer profile parts upon activation of the actuating element, a secure connection of the outer profile parts in the case of fire, as well as a defined conductivity of heat from the fire side to the side facing away from the fire, are ensured. Furthermore, the active movement of the outer profile part connecting element into the engagement position makes it possible to dispose the outer profile part connecting element so as to be spaced or separated from the outer profile parts during normal usage. This separation means that the outer profile part connecting element does not conduct heat across the intermediate space of the composite profile during normal usage, thereby improving the thermal separation of the outer profile parts during normal usage and thus improving the insulating characteristics of the composite profile as a whole.

The actuating element preferably comprises a fire-resistant element and/or material that swells, foams up, generates gases or otherwise moves when exposed to heat in case of fire. Optionally, the actuating element may also comprise a material that releases or disassociates water vapor (or another cooling gas) when exposed to high heat, e.g., through phase transition and/or vaporization of hydrates crystallized in the fire-resistant material. In this case, the actuating element can serve the dual purpose of moving the outer profile part connecting element into the engagement with the first and second outer profile parts in case of a fire and at the same time it can cool the composite profile, thereby contributing to the improved fire resistance properties of the composite profile as a whole.

Further objects, advantages, embodiments and uses of the present teachings will be apparent to the skilled person from the following description of the exemplary embodiments, the appended drawings and the claims.

BRIEF DESCRIPTION OF THE DRAWINGS

FIG. 2 shows a detailed, cross-sectional view through a portion of the representative composite profile of FIG. 1.

FIG. 3 shows a schematic, perspective view of a representative insulating strip having an actuating element and an outer profile part connecting element according to the present teachings.

DETAILED DESCRIPTION OF THE PREFERRED EMBODIMENTS

Figure 1:
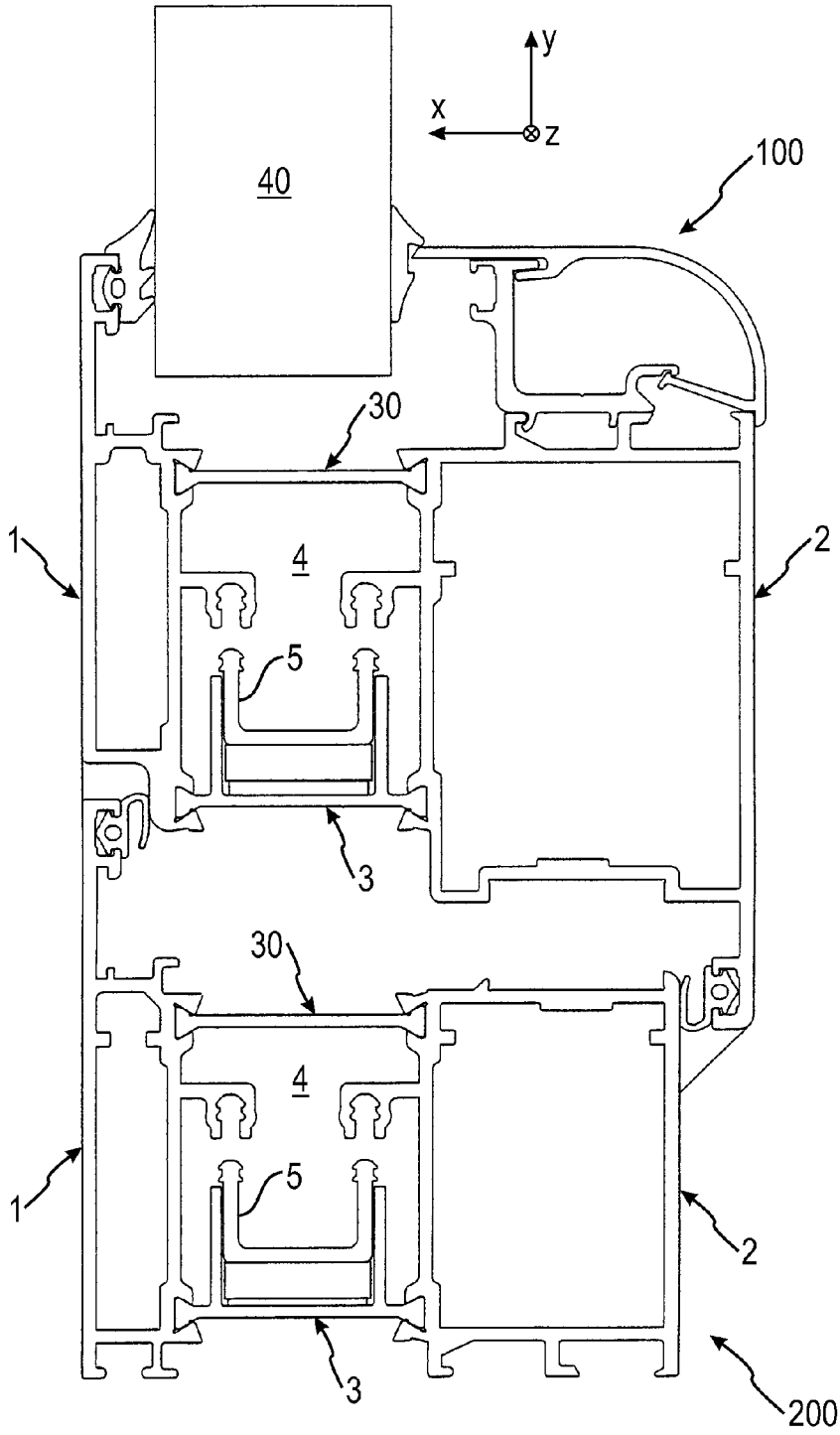
FIG. 1 shows a cross-sectional view of a representative composite profile according to the present teachings being utilized in a door leaf frame and a door casing frame.

Representative, non-limiting examples of the present invention will now be described in further detail with reference to the attached drawings. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide improved composite profiles and insulating strips, as well as methods for using the same.

Moreover, combinations of features and steps disclosed in the following detail description may not be necessary to practice the invention in the broadest sense, and are instead taught merely to particularly describe representative examples of the invention. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

FIG. 1 shows, in a cross-sectional view perpendicular to a longitudinal direction z, a cross-section through a door leaf frame 100 and a door casing frame 200, which are designed in accordance with an embodiment of the present teachings. Since the elements of the door leaf frame 100 and the door casing frame 200 that are relevant to the present teachings coincide, only the door leaf frame 100 will be described to simplify the discussion.

The door leaf frame 100 serves as a representative composite profile according to the present teachings and includes a first outer profile part or frame 1 and a second outer profile part or frame 2. The outer profile parts 1 and 2 are preferably aluminum profiles or frames. Herein, the term "outer profile part" denotes a profile or frame part that is disposed on an outer side of the composite profile, such as e.g., an inner frame or an outer frame. If the composite profile is built into an interior room, such as a door between inner rooms of a building, then it is understood that the outer profile parts are disposed on the respective outer sides of the composite profile. The two aluminum profiles 1, 2 are connected by one or more insulating strips 3, 30 such that an intermediate space 4 is formed between the outer profile parts 1, 2.

The outer profile parts 1, 2 may comprise one or more other metals, such as steel, and/or one or more fireproof synthetic materials, such as a suitable thermosetting plastic, or combinations thereof. The insulating strips 3, 30 preferably comprise a thermoplastic material having a low heat conductivity, such as e.g., PA6. Other materials, which are suitable for forming insulating strips that will contribute to the thermal separation of the outer profile parts, such as PA66, PA66 with glass fiber reinforcement (PA66 GF) or similar polyamides, can also be utilized. Such insulating strips preferably provide the composite profile with a relatively low heat conductivity in the traverse direction x. PA66 has a melting point of about 260° C.

In the embodiment of the door leaf frame 100 shown in FIG. 1, a door leaf 40 is suitably attached to the door leaf frame 100. In the alternative, the door leaf 40 can also be replaced with a glass pane, a façade element or another building structure.

Because the insulating strips 3, 30 are preferably made from a plastic material in order to provide good insulating characteristics, the insulating strips 3, 30 could melt in the event of a fire and as a result, the outer profile parts 1, 2 would no longer be held together by the insulating strips 3, 30. Thus, the melting of the insulating strips 3, 30 could cause the door structure to fail, i.e. fall apart, too quickly in case of a fire, thereby diminishing the passive fire protection characteristics of the composite profile.

In order to provide increased fire-resistance properties to the composite profile, an outer profile part connecting element 5 is provided according to the present teachings. The outer profile part connecting element 5 is preferably designed to move or be moved when the composite profile is exposed to heat in case of fire. The movement of the outer profile part connecting element 5 is designed to be triggered in case of a fire such that it is brought into a fixed and durable engagement with the outer profile parts 1, 2. Thus, the outer profile part connecting element 5 will serve to fixedly and durably connect and hold together the outer profile parts 1, 2, in the event that the insulating strips 3, 30 melt and can thus no longer provide a connecting function.

The design and function of the connecting element 5, as well as a representative, non-limiting actuating element 6 configured to move the connecting element 5 in the event of a fire, will be described in more detail with reference to FIG. 2.

The representative insulating strip 3 shown in FIG. 2 has an insulating strip body 3*k* that extends in the longitudinal direction z, a width b in a transverse direction x perpendicular to the longitudinal direction z and a minimum thickness in a height direction y perpendicular to the longitudinal direction z and the transverse direction x. Connecting elements 3*v* are provided on the respective longitudinal edges 3*r* of the insulating strip body 3*k* and are thus spaced from each other in the transverse direction x. The respective connecting elements 3*v* are configured to connect the insulating strip 3 with the first and second outer profile parts 1, 2. For example, the insulating strip 3 can be connected to the outer profile part 2 by inserting the connecting element 3*v* into the recess 2*c* and then pressing or rolling the hammer 2*e* in the direction towards the abutment 2*f*, thereby durably retaining the connecting element 3*v* between the hammer 2*e* and the abutment 2*f*. Further teachings concerning such connections can be found in FIG. 3 and the associated description of US 2008/0256893, which is incorporated fully herein by reference.

The insulating strip 3 further includes parallel-extending guide walls 3*a*, 3*b*, wherein the mutually-facing inner sides of the guide walls 3*a*, 3*b* are spaced a predetermined distance c from each other. The guide walls 3*a*, 3*b* extend at least in segments in the longitudinal direction z of the insulating strip 3, but may extend continuously along the longitudinal direction z of the insulating strip 3. The guide walls 3*a*, 3*b* project from the insulating strip body 3*k* in the height direction y.

The representative, non-limiting embodiment of the outer profile part connecting element 5 shown in FIGS. 1 to 3 is preferably formed as a metal bracket, preferably made from aluminum or in the alternative made of steel or another metal. The outer profile part connecting element 5 preferably has a relatively high melting/softening temperature so as to durably connect the outer profile parts 1, 2 in case of a fire.

The metal bracket preferably has a U-shape in the cross section perpendicular to the longitudinal direction z, wherein the legs 5*s*, 5*s* of the U-shape extend in parallel and along the longitudinal direction z. The metal bracket may extend continuously along the longitudinal direction z or one or more metal brackets may be provided discontinuously along the longitudinal direction z.

A first engagement section 5*a* is formed on the free end of one leg 5*s*. In this representative embodiment, the first engagement section 5*a* has a rounded head and projections projecting towards the sides that serve as barbs and/or latching elements. A correspondingly-formed second engagement section 5*b* is formed on the other leg 5*s*. The first engagement section 5*a* and the second engagement section 5*b* are separated from each other in the transverse direction x.

The outer profile part 1 includes a projection comprising a third engagement section 1*a* that is complementary to the first engagement section 5*a* of the outer profile part connecting element 5. In this context, the term 'complementary' is understood as encompassing embodiments, in which that the first engagement section 5*a* engages in and/or with the third engagement section 1*a* for the fixed and durable connection of the two parts, e.g., by sliding the first engagement section 5*a* into the third engagement section 1*a*, wherein the two engagement sections 5*a*, 1*a* latch or otherwise catch. The term 'fixed and durable connection' is intended to encompass situations, in which the connecting element 5 can continue to durably maintain a connection of the outer profile parts 1, 2 for at least a predetermined period of time in the event that composite profile is exposed to high temperatures caused, e.g., by a fire.

A second projection having a fourth engagement section 2*b*, which is complementary to the second engagement section 5*b*, is formed in an analogous manner on the second outer profile part 2.

The outer sides of the leg 5*s* are spaced from each other by a distance that corresponds to the spacing c of the inner sides of the walls 3*a* and 3*b* of the insulating strip 3 plus a small tolerance necessary to permit the outer profile part connecting element 5 to slide or move between the guide walls 3*a* and 3*b*. The guide walls 3*a* and 3*b* extend, at least partially, along the longitudinal direction z and in parallel to each other and extend in the height direction y perpendicular to the transverse direction x. As a result, the guide walls 3*a*, 3*b* are configured to guide the outer profile part connecting element 5 when it moves in the height direction y, so that the respective engagement sections 5*a*, 5*b* will properly insert into and engage the corresponding engagement sections 1*a*, 2*b*, respectively.

The guide walls 3*a* and 3*b*, together with the insulating strip body 3*k*, are formed in the shape of a longitudinal trough. In the representative, non-limiting embodiment shown in FIGS. 2 and 3, at least one actuating element 6 is disposed on the bottom of this longitudinal trough between the guide walls 3*a* and 3*b*. Such an actuating element 6 may be, e.g., formed as a self-adhering tape having an epoxy-resin-bound intumescent layer 6*a* and a self-adhesive layer 6*b*. In this case, the actuating element 6 is formed as a self-adhering, fire-resistant strip.

The epoxy-resin-bound intumescent material may comprise, e.g., one or more components that expand or swell up when exposed to temperatures associated with a fire, one or more flame resistant agents and one or more additives. Preferably, the intumescent material is designed to begin to expand or swell up or foam at a temperature of about 200° C. In addition or in the alternative, the intumescent material is preferably capable of achieving a volume increase of up to about 20-fold when exposed to temperatures associated with a fire. Preferably, the actuating element 6 comprises, e.g., a material that releases or disassociates water vapor or other cooling gases when exposed to high heat, e.g., through phase transition and/or vaporization of hydrates crystallized in the fire-resistant material. Such water vaporization provides a cooling effect that further serves to improve the fire-resistance properties of the composite profile as a whole.

The actuating element 6 preferably has a thickness (prior to activation) of, e.g., 3-7 mm, more preferably 5 mm. In this case, an actuating or moving distance of up to about 60-140 mm, more preferably about 100 mm, can theoretically be achieved with this embodiment of the actuating element 6, depending upon any counteracting force acting on the actuating element 6 during its expansion. Representative, but not-limiting, self-adhering intumescent tape products, which are advantageously combinable with the present teachings, are available from Armacell Switzerland AG of Pfaffnau, Switzerland under the product designations Protect-S/30-5 (30 mm tape width) and Protect-S/50-5 (50 mm tape width).

As can be readily recognized from FIGS. 2 and 3, a volume increase of the intumescent layer 6*a* will cause the outer profile part connecting element 5 to be actively moved in the height direction y towards the third engagement section 1*a* and the fourth engagement segment 2*b*. As can also be easily envisioned, this movement can be utilized to cause the first engagement section 5*a* to move into engagement with the first engagement section 1*a* and to cause the second engagement section 5*b* to move into engagement with the fourth engagement section 2*b*.

The actuating element 6 can be embodied in various ways in accordance with the present teachings and it is not limited to an adhesive tape having the intumescent material that swells up or foams when exposed to heat. Other types of actuating elements may also be advantageously utilized with the present teachings, such as bimetal strips and other bimetal elements that bend or otherwise move when exposed to heat and can thus generate an actuating force in the height direction y. In addition or in the alternative, other materials that emit or generate gases when exposed to temperatures associated with a fire can be embedded in or attached to the actuating member. The gases that are generated and escape can impart a pneumatic force that generates the actuating movement. Naturally, a variety of other actuating materials and devices that are triggered by exposure to heat also fall within the scope of the present teachings.

In alternative to a U-shaped outer profile part connecting element 5 that is moved between the guide walls 3*a*, 3*b*, other designs are also possible. For example, an arm can protrude from the insulating strip body 3*a* in the height direction Y and cantilever arms may be attached to the arm via a pivot axis. The cantilever arms may be configured to be rotated or pivoted by the actuating member about the pivot axis, so that corresponding engagement sections on the cantilever arms and the outer profile parts are brought into engagement. The actuating member or the outer profile part connecting elements preferably have a high heat conductivity in comparison to the insulating strips. For this purpose, the length of the outer profile part connecting elements 5 in the longitudinal direction z is selected so that defined heat energy contributions can be conducted from the fire side to the side of the composite profile facing away from the fire.

Of course, other measures for improving the fire resistance properties also can be provided for the composite profile, such as cooling fire resistance elements, etc.

It is particularly advantageous to utilize a cooling intumescent product that can simultaneously generate the actuating force from the volume increase it undergoes when heated.

By using an outer profile part connecting element 5 made of aluminum, together with an insulating strip made of a thermoplastic material, in an aluminum composite profile, it is possible to easily saw the composite profile in a known manner during the finishing process in spite of the improved fire-resistant properties provided by the present teachings.

In the present description, the term 'normal usage of the composite profile' is intended to encompass the state, in which the composite profile has been completely fabricated and, if applicable, has also been installed, e.g., in a building or other structure and the actuating member 6 has not yet been activated. Upon exposure to heat in the case of a fire, the actuating element 6 is activated to generate a movement and thus, the composite profile is no longer in the state of 'normal usage'. In case the composite profile is heated relatively intensively during the manufacture thereof, for example, if the composite profile is powder coated, which takes place at temperatures of up to 200° C., then the activation temperature of the actuating element is selected so that it is preferably somewhat (e.g., 5 to 30° C., preferably about 15° C.) above the temperature of the powder-coating process. In this case, the actuating element 6 will not be activated during the manufacturing process, so that the outer profile part connecting element 5 remains out of engagement with the outer profile parts 1, 2 in the intermediate space 4 and is disposed so as to be thermally separated from the outer profile parts 1, 2 during normal usage of the composite profile.

In the alternative, the present heat-activated actuating members can be utilized in the manufacture of composite profiles that have a durable connection of the outer profile parts 1, 2 already when the composite profile is installed in the building. In this case, the activating temperature of the actuating member can be selected so that the actuating element is fully activated in a certain manufacturing step, e.g., at a powder coating temperature. For example, the outer profile part connecting element 5 may be initially disposed in the intermediate space 4 not in engagement with the outer profile parts 1, 2. Then, e.g., during the powder coating, which usually takes place at the facility of the window or door manufacturer, who has obtained the composite profile as an intermediate product, the actuating element 6 is activated during the powder coating step and the outer profile part connecting element 5 moves into engagement with the outer profile parts 1, 2 as described above, whereby the fixed and durable connection of the outer profile part connecting element 5 with the outer profile parts 1, 2 is produced. While that engagement may reduce the thermal separation or thermal insulation between the outer profile parts 1, 2, it provides an advantageous manufacturing method relative to conventional solutions. That is, the outer profile part connecting element 5 can already be fixedly connected during the fabrication of the composite profile in case the intermediate space 4 is not readily accessible due to the need to roll-in the connecting elements 3*v* into the recess 2*c*.

The invention claimed is:

1. A composite profile suitable for retaining a window, door or façade element, comprising:

a first outer profile part, a second outer profile part, at least one insulating strip connecting the first outer profile part to the second outer profile part, wherein that the first and second outer profile parts are spaced from one another and an intermediate space is defined between the first and second outer profile parts for thermal separation, at least one outer profile part connecting element disposed in the intermediate space not in direct contact, in a first position, with the first outer profile part or the second outer profile part, such that the at least one outer profile part connecting element is spaced from the first and second outer profile parts for thermal separation in the first position, and at least one actuating element arranged and constructed to move the outer profile part connecting element into engagement with the first and second outer profile parts upon being activated by heat, so that the outer profile part connecting element connects the first and second outer profile parts in a second position.

2. A composite profile according to claim 1, wherein the actuating element is disposed between the outer profile part connecting element and the insulating strip.

3. A composite profile according to claim 1, wherein the outer profile parts comprise aluminum, the at least one insulating strip comprises polyamide and the outer profile part connecting element comprises a metal.

4. A composite profile according to claim 1, wherein the actuating element comprises an intumescent material.

5. A composite profile according to claim 1, wherein the actuating element comprises at least one material selected from the group consisting of a bimetal material that moves when exposed to heat, a material that expands when exposed to heat and a material that generates gases when exposed to heat.

6. A composite profile according claim 1, wherein the outer profile part connecting element comprises at least one of a metal and a fireproof synthetic material.

7. A composite profile according to claim 1, wherein the insulating strip comprises an insulating strip body made of a thermoplastic synthetic material and extends in a longitudinal direction, the insulating strip body having:

a first width in a transverse direction perpendicular to the longitudinal direction and a minimum thickness in a height direction perpendicular to the longitudinal direction and the transverse direction, longitudinal edges disposed on opposite ends of the insulating strip body spaced from each other in the transverse direction and connecting the insulating strip with the respective first and second outer profile parts of the composite profile, and guide walls extending from the insulating strip body in the height direction and in parallel with each other, the guide walls being separated by a predetermined first distance and extending at least in sections along the longitudinal direction of the insulating strip body, wherein the at least one actuating element is disposed between the guide walls.

8. A composite profile according to claim 1, wherein the first outer profile part and the second outer profile part have a first heat conductivity, the at least one insulating strip has a second heat conductivity that is lower than the first heat conductivity, the at least one outer profile part connecting element has a third heat conductivity that is higher than the second heat conductivity, the outer profile part connecting element includes a first engagement section and a second engagement section, the first outer profile part includes at least a third engagement section and the second outer profile part includes at least a fourth engagement section, the first engagement section is configured for engagement with the third engagement section, the second engagement section is configured for engagement with the fourth engagement section, and the actuating element is arranged and constructed to move, upon being activated by heat, the first and third engagement sections into mutual engagement and to move the second and fourth engagement sections into mutual engagement, respectively, so that the outer profile part connecting element connects the first and second outer profile parts.

9. A composite profile according to claim 8, wherein the outer profile part connecting element has a U-shape in a cross-section perpendicular to a longitudinal direction of the composite profile, wherein the first and second engagement sections are formed at terminal ends of the U-shape, the third and fourth engagement sections are defined at projections of the first and second outer profile parts and are separated from each other by a distance that corresponds to a distance between the terminal ends of the U-shape, the outer profile part connecting element is disposed in the intermediate space so that the U-shape is oriented in a height direction perpendicular to the separation of the third and fourth engagement sections and in the middle relative to the separation, and the actuating element is arranged and constructed such that, upon activation by heat, the actuating element moves the first and second engagement sections in the height direction of the U-shape towards the third and fourth engagement sections.

10. A composite profile according to claim 9, wherein the actuating element comprises at least one material selected from the group consisting of a bimetal material that moves when exposed to heat, a material that swells up when exposed to heat and a material that generates gases when exposed to heat.

11. A composite profile according claim 10, wherein the outer profile part connecting element comprises at least one of a metal and a fireproof synthetic material.

12. A composite profile according to claim 11, wherein the insulating strip comprises a thermoplastic synthetic material and the first and second outer profile parts are disposed in parallel to each other.

13. A composite profile, comprising:

a first frame comprising at least one metal, a second frame comprising at least one metal, at least one insulating strip connecting the first frame to the second frame such that the first and second frames are spaced from one another and an intermediate space is defined between the first and second outer profile parts, at least one movable connector disposed in the intermediate space not in direct contact with the first frame or the second frame in a first position, and at least one actuator arranged and constructed to move the movable connector into engagement with the first and second frames upon being activated by heat, wherein the movable connector is arranged and constructed to engage and connect the first and second frames in a second position.

14. A composite profile according to claim 13, wherein the movable connector comprises:

at least one first latch configured to engage with the first frame and at least one second latch configured to engage with the second frame.

15. A composite profile according to claim 13, wherein the actuator is configured to move the movable connector away from a main body of the insulating strip.

16. A composite profile according to claim 13, wherein the actuator comprises an intumescent material.

17. A composite profile for window, door or façade elements having predetermined fire resistance properties, comprising:

a first outer profile part, a second outer profile part, at least one insulating strip connected with the first and second outer profile parts so that the first and second outer profile parts are spaced from one another with an intermediate space defined between them for thermal separation, at least one outer profile part connecting element configured to connect the first and second outer profile parts by a durable engagement with the first and second outer profile parts, wherein the at least one outer profile part connecting element is disposed in the intermediate space such that it is not in engagement with the first outer profile part or the second outer profile part and is spaced from them for thermal separation, and a heat-activateable actuating element that is configured, upon activation, to actively move the outer profile part connecting element into engagement with the first and second outer profile parts, so that the outer profile part connecting element connects the first and second outer profile parts.

18. An apparatus comprising:

an insulating strip body extending in a longitudinal direction, having a first width in a transverse direction perpendicular to the longitudinal direction and having a minimum thickness in a height direction perpendicular to the longitudinal direction and the transverse direction, longitudinal edges disposed on opposite ends of the insulating strip body spaced from each other in the transverse direction and being configured to connect the insulating strip body with respective first and second outer profile parts of a composite profile, guide walls extending from the insulating strip body in the height direction and in parallel to each other, the guide walls being separated by a predetermined first distance and extending at least in sections along the longitudinal direction of the insulating strip body, and at least one actuating element that is activated by heat and is disposed between the guide walls, the actuating element being arranged and constructed to generate, upon activation, an actuating force in the height direction of the insulating strip body.

19. An apparatus according to claim 18, further comprising:

at least one outer profile part connecting element disposed between the guide walls and adjacent to the at least one actuating element, the outer profile part connecting element having a U-shape in a cross section to the longitudinal direction, wherein outer sides of legs of the U-shape are spaced slightly less than the first predetermined distance such that the legs that are slidably guidable by the guide walls.

20. An apparatus according to claim 19, further comprising first and second outer profile parts connected to the respective longitudinal edges of the insulating strip body, wherein:

an intermediate space is defined between the first and second outer profile parts for thermal separation, the at least one outer profile part connecting element being disposed in the intermediate space not in direct contact, in a first position, with the first outer profile part or the second outer profile part, such that the at least one outer profile part connecting element is spaced from the first and second outer profile parts for thermal separation in the first position, and the at least one actuating element is arranged and constructed to move the outer profile part connecting element into engagement with the first and second outer profile parts upon being activated by heat, so that the outer profile part connecting element connects the first and second outer profile parts in a second position.

* * * * *